US007124079B1

(12) United States Patent
Johansson et al.

(10) Patent No.: US 7,124,079 B1
(45) Date of Patent: Oct. 17, 2006

(54) SPEECH CODING WITH COMFORT NOISE VARIABILITY FEATURE FOR INCREASED FIDELITY

(75) Inventors: Ingemar Johansson, Luleå (SE); Erik Ekudden, Åkersberga (SE); Roar Hagen, Stockholm (SE)

(73) Assignee: Telefonaktiebolaget LM Ericsson (publ), Stockholm (SE)

( * ) Notice: Subject to any disclaimer, the term of this patent is extended or adjusted under 35 U.S.C. 154(b) by 0 days.

(21) Appl. No.: 09/391,768

(22) Filed: Sep. 8, 1999

Related U.S. Application Data

(60) Provisional application No. 60/109,555, filed on Nov. 23, 1998.

(51) Int. Cl.
*G10L 21/02* (2006.01)

(52) U.S. Cl. ..... 704/226; 704/233; 704/223

(58) Field of Classification Search ..... 704/201, 704/225–228, 233, 223
See application file for complete search history.

(56) References Cited

U.S. PATENT DOCUMENTS 5,485,522 A * 1/1996 Solve et al. ..... 381/56
5,579,435 A * 11/1996 Jansson ..... 704/233
5,630,016 A 5/1997 Swaminathan et al. ..... 395/237
5,657,422 A 8/1997 Janiszewski et al. ..... 395/237
5,960,389 A * 9/1999 Jarvinen et al. ..... 704/215
6,101,466 A * 8/2000 Rao et al. ..... 704/233

FOREIGN PATENT DOCUMENTS

EP 0 843 301 A2 5/1998
EP 0843301 A2 * 5/1998
WO WO 98/48524 10/1998

OTHER PUBLICATIONS

IEEE Communications Magazine; vol. 35, No. 9, Sep. 1997; Benyassine, A.; Shlomot, E.; Su, H.; "ITU-T Recommendation G.729 Annex B: A Silence Compression Scheme for Use with G.729 Optimized for V.70 Digital Simultaneous Voice and Data Applications"; pp. 64-71.
Global Telecommunications Conference; 1989 and Exhibition. Communications Technology for the 1990s and Beyond. GLOBECOM '89, IEEE, 1989, pp. 1070-1074, vol. 2, C.B. Southcott et al. "Voice Control of the Pan-European Digital Mobile Radio System".
ISR PCT/SE 99/02023; Completed May 9, 2000.

* cited by examiner

*Primary Examiner*—Angela Armstrong

(57) ABSTRACT

The quality of comfort noise generated by a speech decoder during non-speech periods is improved by modifying comfort noise parameter values normally used to generate the comfort noise. The comfort noise parameter values are modified in response to variability information associated with a background noise parameter. The modified comfort noise parameter values are then used to generate the comfort noise.

22 Claims, 6 Drawing Sheets

SPEECH CODING WITH COMFORT NOISE VARIABILITY FEATURE FOR INCREASED FIDELITY

This application claims the priority under 35 USC 119(e) (1) of copending U.S. Provisional Application No. 60/109,555, filed on Nov. 23, 1998.

FIELD OF THE INVENTION

The invention relates generally to speech coding and, more particularly, to speech coding wherein artificial background noise is produced during periods of speech inactivity.

BACKGROUND OF THE INVENTION

Speech coders and decoders are conventionally provided in radio transmitters and radio receivers, respectively, and are cooperable to permit speech communications between a given transmitter and receiver over a radio link. The combination of a speech coder and a speech decoder is often referred to as a speech codec. A mobile radiotelephone (e.g., a cellular telephone) is an example of a conventional communication device that typically includes a radio transmitter having a speech coder, and a radio receiver having a speech decoder.

In conventional block-based speech coders the incoming speech signal is divided into blocks called frames. For common 4 kHz telephony bandwidth applications typical framelengths are 20 ms or 160 samples. The frames are further divided into subframes, typically of length 5 ms or 40 samples.

Conventional linear predictive analysis-by-synthesis (LPAS) coders use speech production related models. From the input speech signal, model parameters describing the vocal tract, pitch etc. are extracted. Parameters that vary slowly are typically computed for every frame. Examples of such parameters include the STP (short term prediction) parameters that describe the vocal tract in the apparatus that produced the speech. One example of STP parameters is linear prediction coefficients (LPC) that represent the spectral shape of the input speech signal. Examples of parameters that vary more rapidly include the pitch and innovation shape/gain parameters, which are typically computed every subframe.

The extracted parameters are quantized using suitable well-known scalar and vector quantization techniques. The STP parameters, for example linear prediction coefficients, are often transformed to a representation more suited for quantization such as Line Spectral Frequencies (LSFs). After quantization, the parameters are transmitted over the communication channel to the decoder.

In a conventional LPAS decoder, generally the opposite of the above is done, and the speech signal is synthesized. Postfiltering techniques are usually applied to the synthesized speech signal to enhance the perceived quality.

For many common background noise types a much lower bit rate than is needed for speech provides a good enough model of the signal. Existing mobile systems make use of this fact by adjusting the transmitted bit rate accordingly during background noise. In conventional systems using continuous transmission techniques, a variable rate (VR) speech coder may use its lowest bit rate. In conventional Discontinuous Transmission (DTX) schemes, the transmitter stops sending coded speech frames when the speaker is inactive. At regular or irregular intervals (typically every 500 ms), the transmitter sends speech parameters suitable for generation of comfort noise in the decoder. These parameters for comfort noise generation (CNG) are conventionally coded into what is sometimes called Silence Descriptor (SID) frames. At the receiver, the decoder uses the comfort noise parameters received in the SID frames to synthesize artificial noise by means of a conventional comfort noise injection (CNI) algorithm.

When comfort noise is generated in the decoder in a conventional DTX system, the noise is often perceived as being very static and much different from the background noise generated in active (non-DTX) mode. The reason for this perception is that DTX SID frames are not sent to the receiver as often as normal speech frames. In LPAS codecs having a DTX mode, the spectrum and energy of the background noise are typically estimated (for example, averaged) over several frames, and the estimated parameters are then quantized and transmitted over the channel to the decoder. FIG. 1 illustrates an exemplary prior art comfort noise encoder that produces the aforementioned estimated background noise (comfort noise) parameters. The quantized comfort noise parameters are typically sent every 100 to 500 ms.

The benefit of sending SID frames with a low update rate instead of sending regular speech frames is twofold. The battery life in, for example, a mobile radio transceiver, is extended due to lower power consumption, and the interference created by the transmitter is lowered thereby providing higher system capacity.

In a conventional decoder, the comfort noise parameters can be received and decoded as shown in FIG. 2. Because the decoder does not receive new comfort noise parameters as often as it normally receives speech parameters, the comfort noise parameters which are received in the SID frames are typically interpolated at 23 to provide a smooth evolution of the parameters in the comfort noise synthesis. In the synthesis operation, shown generally at 25, the decoder inputs to the synthesis filter 27 a gain scaled random noise (e.g., white noise) excitation and the interpolated spectrum parameters. As a result, the generated comfort noise $s_c(n)$, will be perceived as highly stationary ("static"), regardless of whether the background noise s(n) at the encoder end (see FIG. 1) is changing in character. This problem is more pronounced in backgrounds with strong variability, such as street noise and babble (e.g., restaurant noise), but is also present in car noise situations.

One conventional approach to solving this "static" comfort noise problem is simply to increase the update rate of DTX comfort noise parameters (e.g., use a higher SID frame rate). Exemplary problems with this solution are that battery consumption (e.g., in a mobile transceiver) will increase because the transmitter must be operated more often, and system capacity will decrease because of the increased SID frame rate. Thus, it is common in conventional systems to accept the static background noise.

It is therefore desirable to avoid the aforementioned disadvantages associated with conventional comfort noise generation.

According to the invention, conventionally generated comfort noise parameters are modified based on properties of actual background noise experienced at the encoder. Comfort noise generated from the modified parameters is perceived as less static than conventionally generated comfort noise, and more similar to the actual background noise experienced at the encoder.

DETAILED DESCRIPTION

Figure 2:
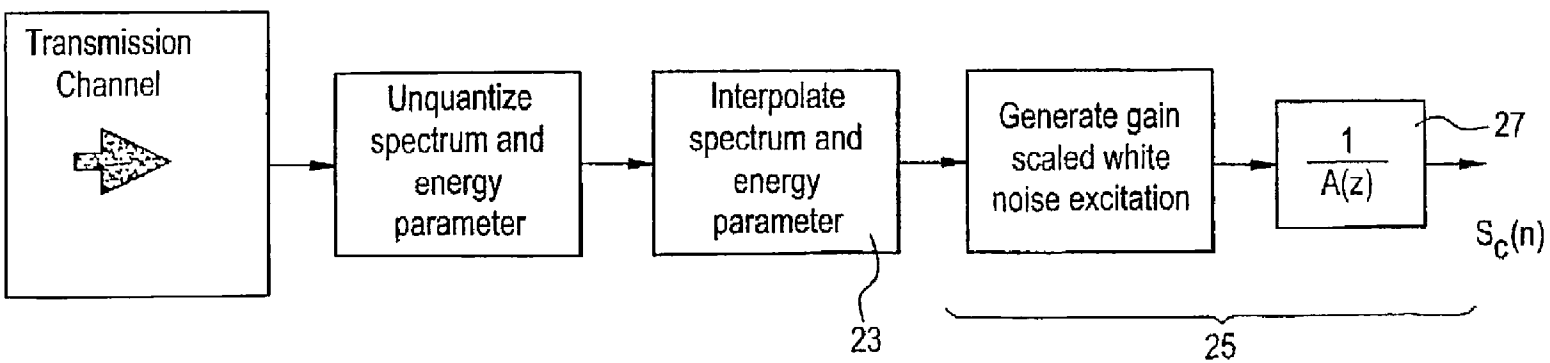
FIG. 2 PRIOR ART
FIG. 2 diagrammatically illustrates the generation of comfort noise in a conventional speech decoder.
Figure 3:
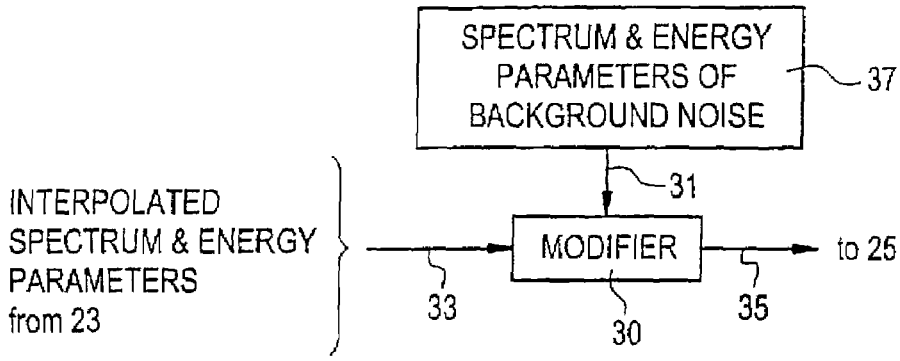
FIG. 3 illustrates a comfort noise parameter modifier for use in generating comfort noise according to the invention.

FIG. 3 illustrates a comfort noise parameter modifier 30 for modifying comfort noise parameters according to the invention. In the example of FIG. 3, the modifier 30 receives at an input 33 the conventional interpolated comfort noise parameters, for example the spectrum and energy parameters output from interpolator 23 of FIG. 2. The modifier 30 also receives at input 31 spectrum and energy parameters associated with background noise experienced at the encoder. The modifier 30 modifies the received comfort noise parameters based on the background noise parameters received at 31 to produce modified comfort noise parameters at 35. The modified comfort noise parameters can then be provided, for example, to the comfort noise synthesis section 25 of FIG. 2 for use in conventional comfort noise synthesis operations. The modified comfort noise parameters provided at 35 permit the synthesis section 25 to generate comfort noise that reproduces more faithfully the actual background noise presented to the speech encoder.

Figure 4:
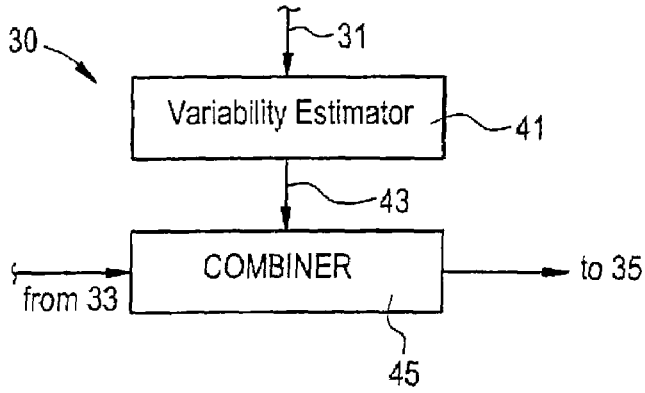
FIG. 4 illustrates an exemplary embodiment of the modifier of FIG. 3.

FIG. 4 illustrates an exemplary embodiment of the comfort noise parameter modifier 30 of FIG. 3. The modifier 30 includes a variability estimator 41 coupled to input 31 in order to receive the spectrum and energy parameters of the background noise. The variability estimator 41 estimates variability characteristics of the background noise parameters, and outputs at 43 information indicative of the variability of the background noise parameters. The variability information can characterize the variability of the parameter about the mean value thereof, for example the variance of the parameter, or the maximum deviation of the parameter from the mean value thereof.

The variability information at 43 can also be indicative of correlation properties, the evolution of the parameter over time, or other measures of the variability of the parameter over time. Examples of time variability information include simple measures such as the rate of change of the parameter (fast or slow changes), the variance of the parameter, the maximum deviation of the mean, other statistical measures characterizing the variability of the parameter, and more advanced measures such as autocorrelation properties, and filter coefficients of an auto-regressive (AR) predictor estimated from the parameter. One example of a simple rate of change measure is counting the zero crossing rate, that is, the number of times that the sign of the parameter changes when looking from the first parameter value to the last parameter value in the sequence of parameter values. The information output at 43 from the estimator 41 is input to a combiner 45 which combines the output information at 43 with the interpolated comfort noise parameters received at 33 in order to produce the modified comfort noise parameters at 35.

Figure 5:
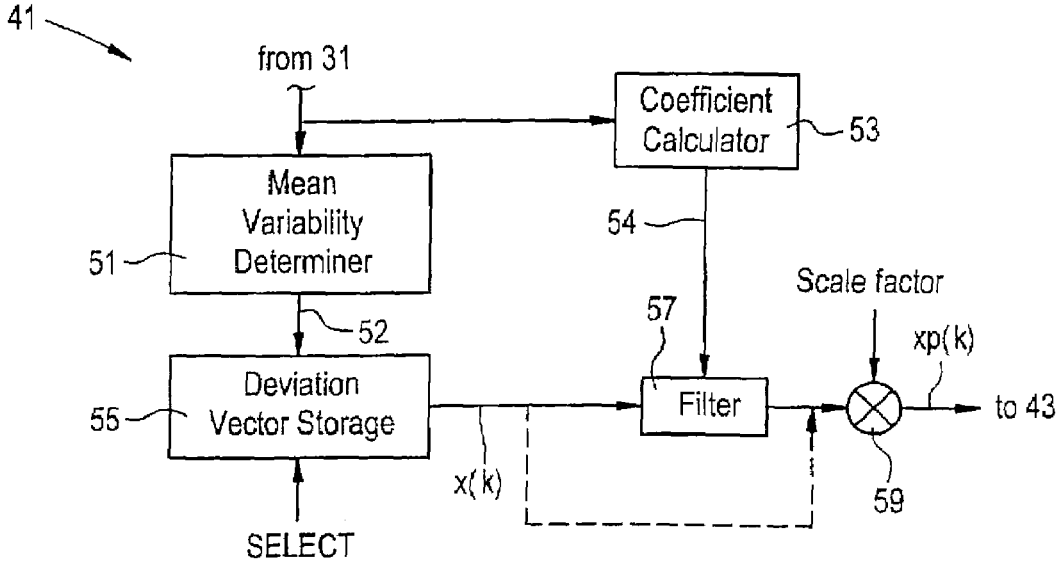
FIG. 5 illustrates an exemplary embodiment of the variability estimator of FIG. 4.

FIG. 5 illustrates an exemplary embodiment of the variability estimator 41 of FIG. 4. The estimator of FIG. 5 includes a mean variability determiner 51 coupled to input 31 for receiving the spectrum and energy parameters of the background noise. The mean variability determiner 51 can determine mean variability characteristics as described above. For example, if the background noise buffer 37 of FIG. 3 includes 8 frames and 32 subframes, then the variability of the buffered spectrum and energy parameters can be analyzed as follows. The mean (or average) value of the buffered spectrum parameters can be computed (as is conventionally done in DTX encoders to produce SID frames) and subtracted from the buffered spectrum parameter values, thereby yielding a vector of spectral deviation values. Similarly, the mean subframe value of the buffered energy parameters can be computed (as is conventionally done in DTX encoders to produce SID frames), and then subtracted from the buffered subframe energy parameter values, thereby yielding a vector of energy deviation values. The spectrum and energy deviation vectors thus comprise mean-removed values of the spectrum and energy parameters. The spectrum and energy deviation vectors are communicated from the variability determiner 51 to a deviation vector storage unit 55 via a communication path 52.

A coefficient calculator 53 is also coupled to the input 31 in order to receive the background noise parameters. The exemplary coefficient calculator 53 is operable to perform conventional AR estimations on the respective spectrum and energy parameters. The filter coefficients resulting from the AR estimations are communicated from the coefficient calculator 53 to a filter 57 via a communication path 54. The filter coefficients calculated at 53 can define, for example, respective all-pole filters for the spectrum and energy parameters.

In one embodiment, the coefficient calculator 53 performs first order AR estimations for both the spectrum and energy parameters, calculating filter coefficients a1=Rxx(1)/Rxx(0) for each parameter in conventional fashion. Rxx(0) and Rxx(1) values are conventional autocorrelation values of the particular parameter:

$$Rxx(0) = \sum_{n=0}^{N-1} x(n) * x(n)$$

$$Rxx(1) = \sum_{n=0}^{N-1} x(n) * x(n-1)$$

In these Rxx calculations, x represents the background noise (e.g., spectrum or energy) parameter. A positive value of a1 generally indicates that the parameter is varying slowly, and a negative value generally indicates rapid variation.

According to one embodiment, for each frame of the spectrum parameters, and for each subframe of the energy parameters, a component x(k) from the corresponding deviation vector can be, for example, randomly selected (via a SELECT input of storage unit 55) and filtered by the filter 57 using the corresponding filter coefficients. The output from the filter is then scaled by a constant scale factor via a scaling apparatus 59, for example a multiplier. The scaled output, designated as xp(k) in FIG. 5, is provided to the input 43 of the combiner 45 of FIG. 4.

Figure 5A:
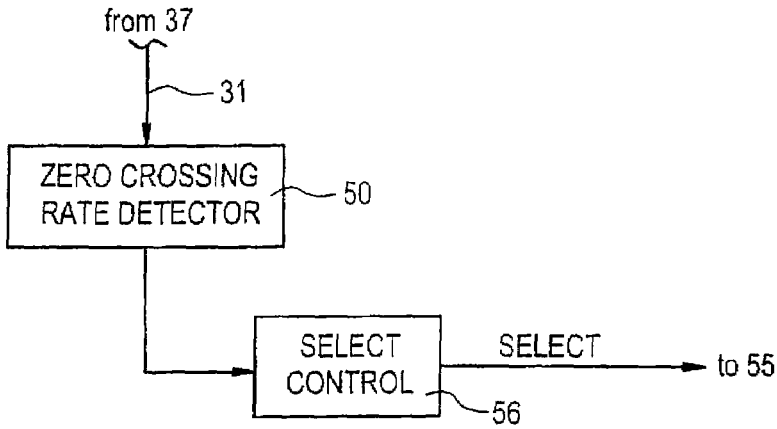
FIG. 5A illustrates exemplary control of the SELECT signal of FIG. 5.

In one embodiment, illustrated diagrammatically in FIG. 5A, a zero crossing rate determiner 50 is coupled at 31 to receive the buffered parameters at 37. The determiner 50 determines the respective zero crossing rates of the spectrum and energy parameters. That is, for the sequence of energy parameters buffered at 37, and also for the sequence of spectrum parameters buffered at 37, the zero crossing rate determiner 50 determines the number of times in the respective sequence that the sign of the associated parameter value changes when looking from the first parameter value to the last parameter value in the buffered sequence. This zero crossing rate information can then be used at 56 to control the SELECT signal of FIG. 5.

For example, for a given deviation vector, the SELECT signal can be controlled to randomly select components x(k) of the deviation vector relatively more frequently (as often as every frame or subframe) if the zero crossing rate associated with that parameter is relatively high (indicating relatively high parameter variability), and to randomly select components x(k) of the deviation vector relatively less frequently (e.g., less often than every frame or subframe) if the associated zero crossing rate is relatively low (indicating relatively low parameter variability). In other embodiments, the frequency of selection of the components x(k) of a given deviation vector can be set to a predetermined, desired value.

The combiner of FIG. 4 operates to combine the scaled output xp(k) with the conventional comfort noise parameters. The combining is performed on a frame basis for spectral parameters, and on a subframe basis for energy parameters. In one example, the combiner 45 can be an adder that simply adds the signal xp(k) to the conventional comfort noise parameters. The scaled output xp(k) of FIG. 5 can thus be considered to be a perturbing signal which is used by the combiner 45 to perturb the conventional comfort noise parameters received at 33 in order to produce the modified (or perturbed) comfort noise parameters to be input to the comfort noise synthesis section 25 (see FIGS. 2–4).

The conventional comfort noise synthesis section 25 can use the perturbed comfort noise parameters in conventional fashion. Due to the perturbation of the conventional parameters, the comfort noise produced will have a semi-random variability that significantly enhances the perceived quality for more variable backgrounds such as babble and street noise, as well as for car noise.

The perturbing signal xp(k) can, in one example, be expressed as follows:

$$xp(k)=\beta_x\cdot(b0_x\cdot x(k)-a1_x\cdot\gamma_x\cdot(xp(k-1)),$$

where $\beta_x$ is a scaling factor, $b0_x$ and $a1_x$ are filter coefficients, and $\gamma_x$ is a bandwidth expansion factor.

The broken line in FIG. 5 illustrates an embodiment wherein the filtering operation is omitted, and the perturbing signal xp(k) comprises scaled deviation vector components.

Figure 9:
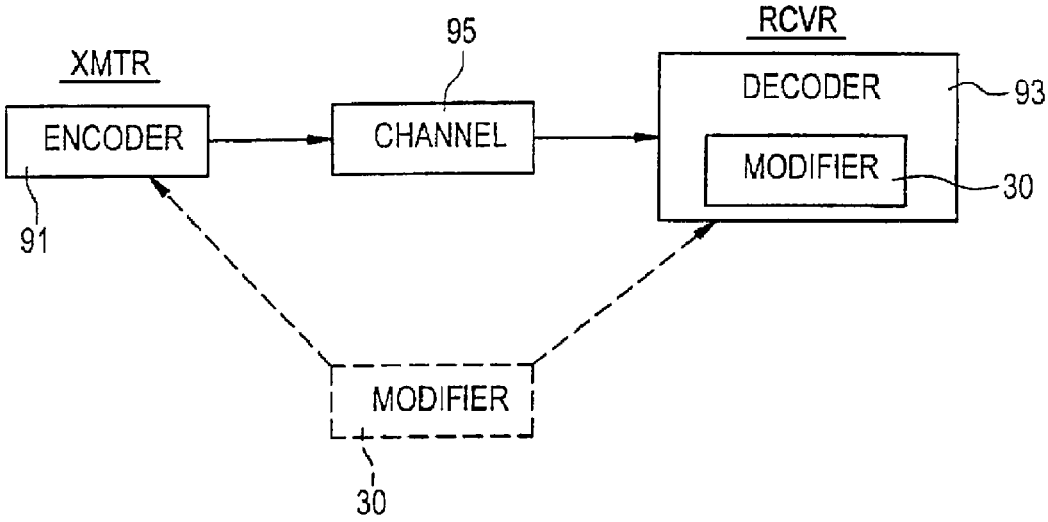
FIG. 9 illustrates a voice communication system in which the modifier embodiments of FIGS. 3–8 can be implemented.

In some embodiments, the modifier 30 of FIGS. 3–5 is provided entirely within the speech decoder (see FIG. 9), and in other embodiments the modifier of FIGS. 3–5 is distributed between the speech encoder and the speech decoder (see broken lines in FIG. 9). In embodiments where the modifier 30 is provided entirely in the decoder, the background noise parameters shown in FIG. 3 must be identified as such in the decoder. This can be accomplished by buffering at 37 a desired amount (frames and subframes) of the spectrum and energy parameters received from the encoder via the transmission channel. In a DTX scheme, implicit information conventionally available in the decoder can be used to decide when the buffer 37 contains only parameters associated with background noise. For example, if the buffer 37 can buffer N frames, and if N frames of hangover are used after speech segments before the transmission is interrupted for DTX mode (as is conventional), then these last N frames before the switch to DTX mode are known to contain spectrum and energy parameters of background noise only. These background noise parameters can then be used by the modifier 30 as described above.

Figure 1:
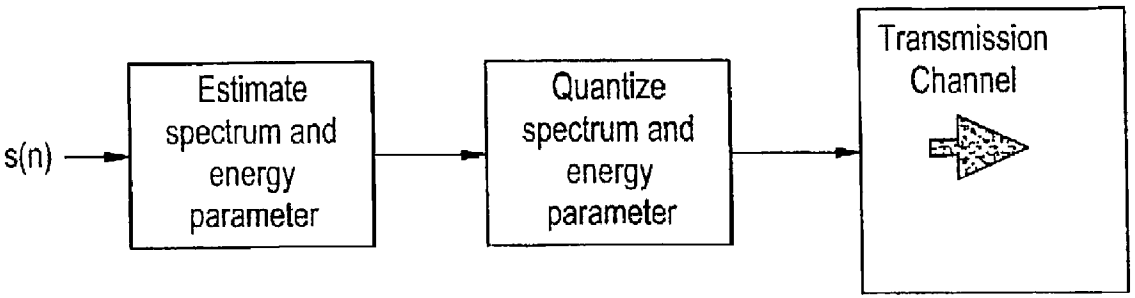
FIG. 1 PRIOR ART
FIG. 1 diagrammatically illustrates the production of comfort noise parameters in a conventional speech encoder.

In embodiments where the modifier 30 is distributed between the encoder and the decoder, the mean variability determiner 51 and the coefficient calculator 53 can be provided in the encoder. Thus, the communication paths 52 and 54 in such embodiments are analogous to the conventional communication path used to transmit conventional comfort noise parameters from encoder to decoder (see FIGS. 1 and 2). More particularly, as shown in example FIG. 6, the paths 52 and 54 proceed through a quantizer (see also FIG. 1), a communication channel (see also FIGS. 1 and 2) and an unquantizing section (see also FIG. 2) to the storage unit 55 and the filter 57, respectively (see also FIG. 5). Well known techniques for quantization of scalar values as well as AR filter coefficients can be used with respect to the mean variability and AR filter coefficient information.

Figure 6:
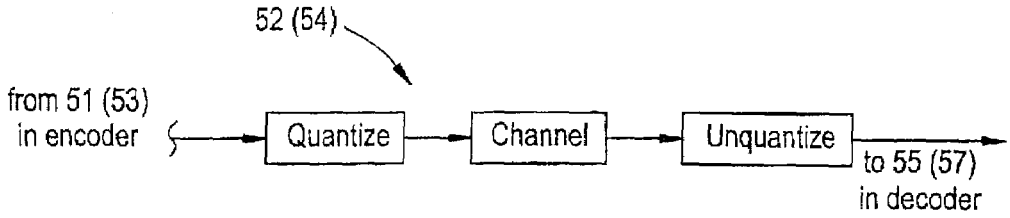
FIG. 6 illustrates an exemplary embodiment of the modifier of FIGS. 3–5, wherein the variability estimator of FIG. 5 is provided partially in the encoder and partially in the decoder.

The encoder knows, by conventional means, when the spectrum and energy parameters of background noise are available for processing by the mean variability determiner 51 and the coefficient calculator 53, because these same spectrum and energy parameters are used conventionally by the encoder to produce conventional comfort noise parameters. Conventional encoders typically calculate an average energy and average spectrum over a number of frames, and these average spectrum and energy parameters are transmitted to the decoder as comfort noise parameters. Because the filter coefficients from coefficient calculator 53 and the deviation vectors from mean variability determiner 51 must be transmitted from the encoder to the decoder across the transmission channel as shown in FIG. 6, extra bandwidth is required when the modifier is distributed between the encoder and the decoder. In contrast, when the modifier is provided entirely in the decoder, no extra bandwidth is required for its implementation.

Figure 7:
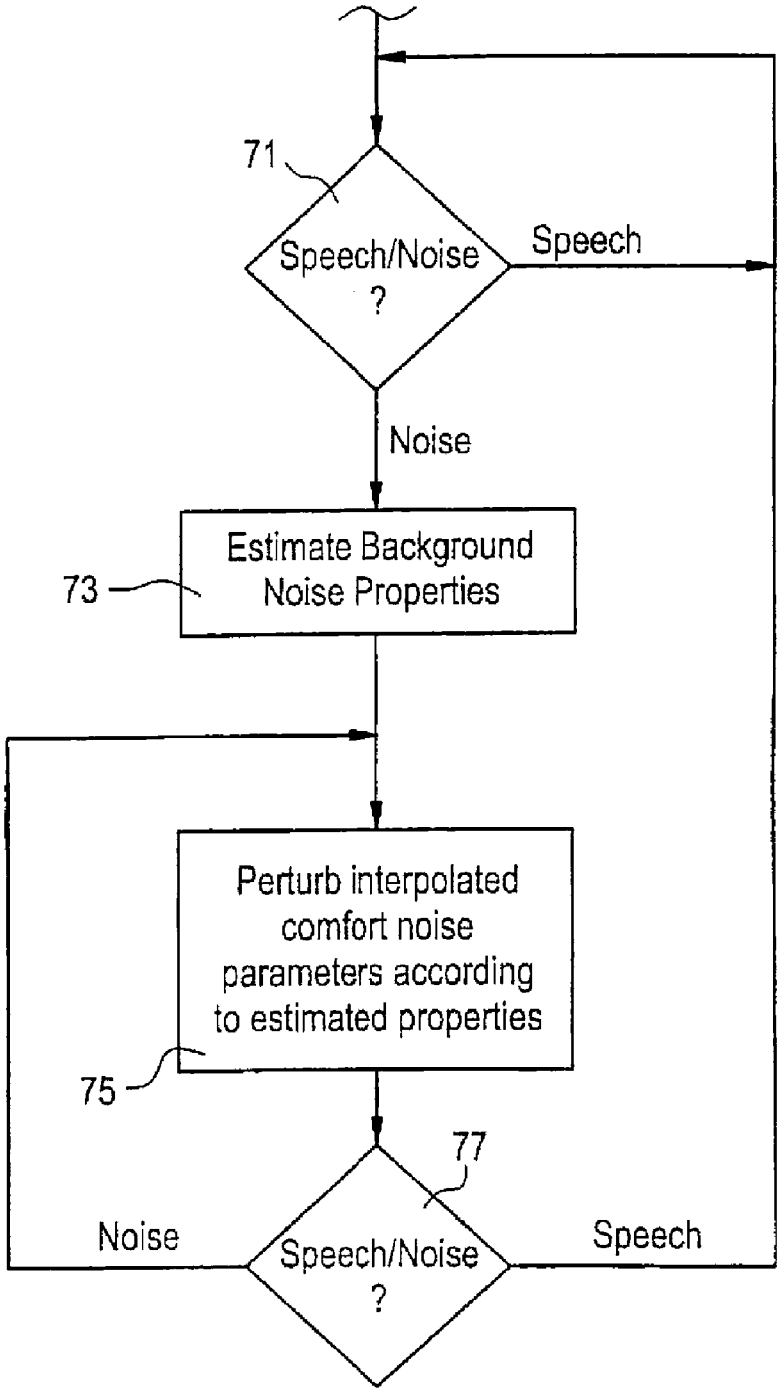
FIG. 7 illustrates exemplary operations which can be performed by the modifier of FIGS. 3–6.

FIG. 7 illustrates the above-described exemplary operations which can be performed by the modifier embodiments of FIGS. 3–5. It is first determined at 71 whether the available spectrum and energy parameters (e.g., in buffer 37 of FIG. 3) are associated with speech or background noise. If the available parameters are associated with background noise, then properties of the background noise, such as mean variability and time variability are estimated at 73. Thereafter at 75, the interpolated comfort noise parameters are perturbed according to the estimated properties of the background noise. The perturbing process at 75 is continued as long as background noise is detected at 77. If speech activity is detected at 77, then availability of further background noise parameters is awaited at 71.

Figure 8:
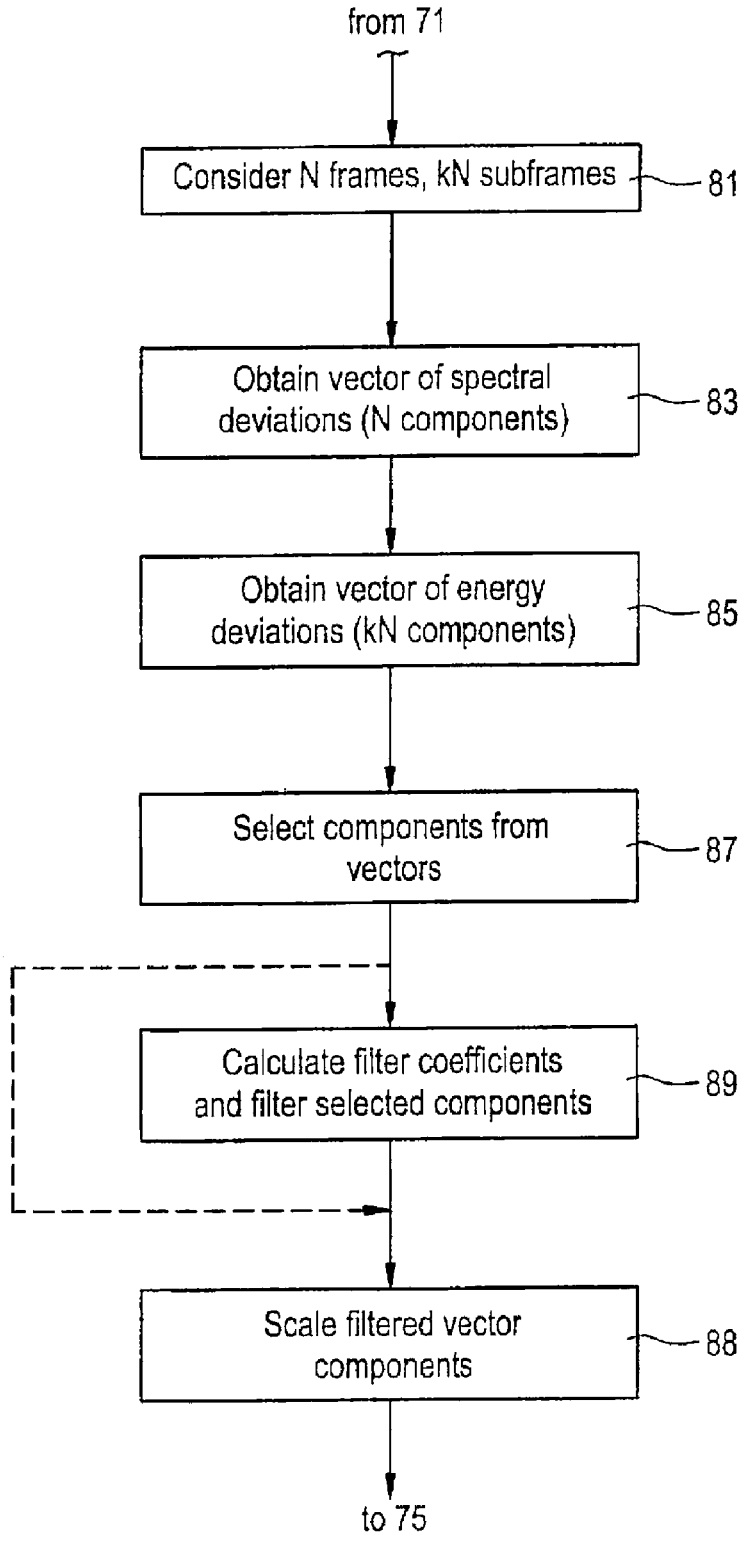
FIG. 8 illustrates an example of the estimating step of FIG. 7.

FIG. 8 illustrates exemplary operations which can be performed during the estimating step 73 of FIG. 7. The processing considers N frames and kN subframes at 81, corresponding to the aforementioned N buffered frames. In one embodiment, N=8 and k=4. A vector of spectrum deviations having N components is obtained at 83 and a vector of energy deviations having kn components is obtained at 85. At 87, a component is selected (for example, randomly) from each of the deviation vectors. At 89, filter coefficients are calculated, and the selected vector components are filtered accordingly. At 88, the filtered vector components are scaled in order to produce the perturbing signal that is used at step 75 in FIG. 7. The broken line in FIG. 8 corresponds to the broken line embodiments of FIG. 5, namely the embodiments wherein the filtering is omitted and scaled deviation vector components are used as the perturbing parameters.

FIG. 9 illustrates an exemplary voice communication system in which the comfort noise parameter modifier embodiments of FIGS. 3–8 can be implemented. A transmitter XMTR includes a speech encoder 91 which is coupled to a speech decoder 93 in a receiver RCVR via a transmission channel 95. One or both of the transmitter and receiver of FIG. 9 can be part of, for example, a radiotelephone, or other component of a radio communication system. The channel 95 can include, for example, a radio communication channel. As shown in FIG. 9, the modifier embodiments of FIGS. 3–8 can be implemented in the decoder, or can be distributed between the encoder and the decoder (see broken lines) as described above with respect to FIGS. 5 and 6.

It will be evident to workers in the art that the embodiments of FIGS. 3–9 above can be readily implemented, for example, by suitable modifications in software, hardware, or both, in conventional speech codecs.

The invention described above improves the naturalness of background noise (with no additional bandwidth or power cost in some embodiments). This makes switching between speech and non-speech modes in a speech codec more seamless and therefore more acceptable for the human ear.

Although exemplary embodiments of the present invention have been described above in detail, this does not limit the scope of the invention, which can be practiced in a variety of embodiments.

The invention claimed is:

1. In a speech decoder that receives speech and noise information from a communication channel, an apparatus for producing comfort noise parameters for use in generating comfort noise, said apparatus comprising:

a first input for providing a plurality of interpolated comfort noise parameter values normally used by the speech decoder to generate comfort noise;

a second input for providing values of a background noise parameter from a receiver buffer;

a variability estimator coupled to said second input and responsive to the background noise parameter values for calculating variability information, wherein said variability estimator is responsive to a plurality of values of the background noise parameter for calculating a mean value of the background noise parameter over a period of time, wherein said variability estimator includes a variability determiner for producing variability information indicative of how the background noise parameter varies relative to said mean value of the background noise parameter, and is further operable to calculate differences between the mean value and at least some of the background noise parameter values to produce mean-removed values of the background noise parameter;

a modifier coupled to said first and second inputs and responsive to the variability information indicative of the variability of the mean-removed values of the background noise parameter to the mean value of the background noise parameter for perturbing the comfort noise parameter values to produce perturbed comfort noise parameter values; and an output coupled to said modifier for selecting at least one of said perturbed comfort noise parameter values for use in generating perturbed comfort noise.

2. The apparatus of claim 1, wherein said variability information includes time variability information indicative of how the background noise parameter varies over time.

3. The apparatus of claim 2, wherein said variability estimator includes a coefficient calculator responsive to a plurality of values of the background noise parameter for calculating filter coefficients, said time variability information including the filter coefficients.

4. The apparatus of claim 3, wherein said filter coefficients are filter coefficients of an auto-regressive predictor filter.

5. The apparatus of claim 3, including a filter coupled to said coefficient calculator for receiving therefrom said filter coefficients, and coupled to said mean variability determiner for filtering at least some of the mean-removed background noise parameter values according to said filter coefficients.

6. The apparatus of claim 3, wherein said coefficient calculator is provided in the speech decoder.

7. The apparatus of claim 1, wherein the output is adapted to select the at least one perturbed comfort noise parameter value based upon a sequential order of the background noise parameter values provided from the receiver buffer.

8. The apparatus of claim 1, wherein said perturbed comfort noise values are selected randomly.

9. The apparatus of claim 1, wherein the output includes means for setting to a predetermined value, a frequency at which perturbed comfort noise parameter values are selected.

10. The apparatus of claim 1, wherein the modifier randomly selects one of the mean-removed values, scales the randomly selected mean-removed value by a scale factor to produce a scaled mean-removed value, and combines the scaled mean-removed value with one of the comfort noise parameter values to produce one of the perturbed comfort noise parameter values.

11. In a method of generating comfort noise in a speech decoder, in which the speech decoder receives speech information and a plurality of comfort noise parameter values from an encoder via a communication channel, and the decoder interpolates the plurality of comfort noise parameter values and generates comfort noise from the interpolated comfort noise parameter values, an improvement comprising:

obtaining by the speech decoder, background noise parameter values from a receiver buffer, said background noise parameter values representing actual background noise;

calculating, at the speech decoder, a mean value of the background noise parameter values over a period of time;

calculating, at the speech decoder, variability information indicative of how the background noise parameter values vary relative to the calculated mean value of the background noise parameter values;

in response to the variability information, perturbing the interpolated comfort noise parameter values by the speech decoder to produce perturbed comfort noise parameter values; and selecting by the speech decoder, at least some of the perturbed comfort noise parameter values for use in generating perturbed comfort noise.

12. The method of claim 11, wherein the background noise parameter is a spectrum parameter.

13. The method of claim 11, wherein the step of calculating variability information includes subtracting the mean value from each background noise parameter value to produce a plurality of deviation values.

14. The method of claim 13, wherein said perturbing step includes selecting one of said deviation values randomly, scaling the randomly selected deviation value by a scale factor to produce a scaled deviation value, and combining the scaled deviation value with one of the comfort noise parameter values to produce one of the perturbed comfort noise parameter values.

15. The method of claim 11, wherein said speech decoder is provided in a radio communication device.

16. The method of claim 15, wherein speech decoder is provided in a cellular telephone.

17. The method of claim 11, wherein the step of calculating variability information includes calculating differences between the mean value and at least some of the background noise parameter values to produce mean-removed values of the background noise parameter.

18. The method of claim 17, wherein the step of calculating variability information includes using the plurality of values of the background noise parameter to calculate filter coefficients, and filtering at least some of the mean-removed values of the background noise parameter according to the filter coefficients.

19. The method of claim 18, wherein the step of calculating variability information includes calculating filter coefficients of an auto-regressive predictor filter.

20. The method of claim 11, wherein said variability information includes time variability information indicative of how the background noise parameter values vary over time.

21. The method of claim 11, wherein the step of calculating variability information includes combining the variability information for the background noise parameter values with the interpolated comfort noise parameter values on a frame basis.

22. The method of claim 11, wherein the step of calculating variability information includes determining at least one variability factor from a group consisting of:

time rate of change;

variance from a mean value;

maximum deviation from a mean value; and zero crossing rate.

* * * * *